US005387261A

United States Patent [19]

Yamada et al.

[11] Patent Number: 5,387,261

[45] Date of Patent: Feb. 7, 1995

[54] KEYBOARD SWITCH ASSEMBLY

[75] Inventors: Kazunori Yamada; Fumio Watanabe; Hidemasa Sakurada, all of Tokyo, Japan

[73] Assignee: SMK Corporation, Tokyo, Japan

[21] Appl. No.: 131,201

[22] Filed: Oct. 1, 1993

[30] Foreign Application Priority Data

Oct. 1, 1992 [JP] Japan ..... 4-074433[U]

[51] Int. Cl.[6] ..... B41J 5/12

[52] U.S. Cl. ..... 400/490; 200/344; 400/495; 400/496; 400/472

[58] Field of Search ..... 400/490, 491, 491.2, 400/495, 495.1, 496, 472, 473; 200/339, 341, 344, 345, 520

[56] References Cited

U.S. PATENT DOCUMENTS

| | | | |
|---|---|---|---|
| 4,453,063 | 6/1984 | Wanatowicz, Jr. et al. | 200/340 |
| 4,468,145 | 8/1984 | Denley | 400/496 |
| 4,475,832 | 10/1984 | Wachs | 400/496 |
| 4,535,210 | 8/1985 | Shedore et al. | 200/344 |
| 4,771,146 | 9/1988 | Suzuki et al. | 400/496 |
| 4,802,779 | 2/1989 | Allaire | 400/490 |
| 4,830,526 | 5/1989 | Hosono | 400/490 |
| 4,950,093 | 8/1990 | Ertl | 400/472 |
| 5,003,140 | 3/1991 | Abell, Jr. et al. | 200/344 |

*Primary Examiner*—Edgar S. Burr
*Assistant Examiner*—Lynn D. Hendrickson
*Attorney, Agent, or Firm*—Peter J. Gluck; Mark A. Catan

[57] ABSTRACT

A semilunar recess affixed to a key cap of a keyboard switch is snapped over a swing rod, rotatably affixed to a key seat, during assembly of the keyboard switch. The swing rod is supported by the key seat in a position permitting the semilunar recess to snap onto it. This arrangement permits single-step assembly of keys to a keyboard.

12 Claims, 7 Drawing Sheets

KEYBOARD SWITCH ASSEMBLY

BACKGROUND OF THE INVENTION

This invention relates to keyboard switch assemblies for inputting data to computers and other electronic devices. In particular, this invention relates to a mechanism for keyboard key switches that prevents key caps from tilting or rotating when the key caps are pressed by an operator.

A known mechanism for preventing key caps from tilting and rotating employs an element called a swing rod. Large key caps are assembled to respective key seats in several steps because a swing rod mechanism must be installed to the large key caps and their respective key seats. Small keys do not require a swing rod mechanism to maintain their orientations because forces generated by normal use are small enough to be resisted by guides in an incorporated electrical switch. The absence of a swing rod mechanism permits assembly of small key caps to respective key seats in a single-step operation. This results in a substantial saving in manufacturing cost.

A prior art key switch assembly employing swing rods is shown in FIGS. 13*a* to 13*c*, in which a key switch assembly 40, according to the prior art, employs a coil spring (not shown) to urge a key cap 27 upward from a key seat 24.

Referring to FIG. 13*d*, a swing rod 2 has two arms 2*c* and a center portion 2*a* that define three sides of a rectangle. Each of arms 2*c* is connected to a tip 2*b* that extends partly along a fourth side of the rectangle. Tips 2*b* extend inward from opposite ends of the fourth side of the rectangle.

Referring again to FIGS. 13*a*–13*c*, tips 2*b* are rotatably anchored by a pair of bearings 5 to key seat 24. Center portion 2*a* is rotatably held at two ends in a pair of grips 3 on key cap 27. Center portion 2*a* extends nearly an entire length of key cap 27.

Without swing rod 2, a lateral or uneven force imposed on key cap 27 tends to tilt it. Key cap 27 would then bind in a switching mechanism (not shown) when tilted. Such binding makes it difficult to stroke key cap 27 smoothly. With swing rod 2, a force tending to tilt key cap 27 forces downward a first end of key cap 27. A resulting downward movement of the first end of key cap 27 forces down a first end of center portion 2*a* and a first one of arms 2*c*, contiguous with the first end of center portion 2*a*. At the same time, tip 2*b* of the first one of arms 2*c* is prevented from shifting downward by its anchoring block 19. Thus, the first arm 2*c* rotates center portion 2*a* about an axis of center portion 2*a*. Rotation of swing rod 2 rotates a second arm 2*c*. Since the second arm 2*c* is held down by another anchoring block 19, the second arm 2*c* forces downward a second end of center portion 2*a*, contiguous with the second arm 2*c*. The second end of center portion 2*a* moves key cap 27 down with it because center portion 2*a* is coupled at the second one of its ends to key cap 27 by one of grips 3.

Swing rod 2 rotates every time key cap 27 is pressed, transmitting any downward forces on one edge of key cap 27 to an opposite edge of key cap 27. Thus, initial tilting of key cap 27 about an axis perpendicular to both the axis of center portion 2*a* and a direction of stroke, generates an opposing moment caused by the rotation of swing rod 2. The opposing moment tends to prevent key cap 27 from tilting further.

Referring to FIG. 13*a*, during assembly, key cap 27 is mounted onto key seat 24 as follows. First, tips 2*b* of swing rod 2 are placed on top of bearings 5, each of which has an access groove facing upwardly. Tips 2*b* are then pressed into bearings 5. Next, center portion 2*a* is fitted into grips 3 of key cap 27.

Referring to FIG. 13*b*, swing rod 2 and key cap 27 are next pivoted about bearings 5 toward key seat 24 bringing them to their home operating positions.

Referring to FIG. 13*c*, swing rod 2 and key cap 27 are shown in their home operating positions.

During assembly of the prior art key switch of FIGS. 13*a*–13*c*, center portion 2*a* and tips 2*b* of swing rod 2 are press-fitted to key cap 27 and key seat 24, in separate steps. It is difficult to keep center portion 2*a* from detaching from grips 3 when key cap 27 is moved to its home operating position as shown in the sequence of FIGS. 13*a* to 13*c*. According to the prior art arrangement, it is almost impossible to mount all key caps 27 of a keyboard to corresponding key seats 24 in a single-step operation. Therefore, efficiency and cost-effectiveness of the assembly process are sacrificed.

It would be desirable to have a keyboard assembly which permits single-step assembly of large key switches that require swing rod mechanisms. Single-step assembly of such large key switches permits the assembly of all keys of an entire keyboard, including small and large keys, in a single step.

OBJECTS AND SUMMARY OF THE INVENTION

It is an object of the present invention to provide a keyboard assembly which overcomes the drawbacks of the prior art.

It is a further object of the present invention to provide a keyboard assembly that permits simple and inexpensive assembly of key caps and swing rods, to their respective key seats.

It is a further object of the present invention to provide a keyboard assembly which permits accurate assembly of key caps and swing rods to their respective key seats.

It is a further object of the present invention to provide a keyboard assembly which permits single-step assembly of large key caps, employing swing rod mechanisms, to respective key seats.

It is a still further object of the present invention to provide an operationally effective swing rod mechanism.

Briefly stated, the present invention provides a key switch assembly that includes a semilunar recess affixed to a key cap. The semilunar recess is snapped over a swing rod, rotatably affixed to a key seat, during assembly of the keyboard switch. The swing rod is supported by the key seat in a position permitting the semilunar recess to snap onto it. This arrangement permits single-step assembly of keys to respective key seats of a keyboard.

According to an embodiment of the present invention, there is disclosed, a keyboard switch assembly, comprising: a key cap, a key seat, separate from the key cap, means for limiting a movement of the key cap to a specified distance from the key seat, means for urging the key cap away from the key seat until movement is stopped by the means for limiting, a swing rod, a center portion on the swing rod, a first arm affixed to a first end of the center portion, a second arm affixed to a second end of the center portion, the first and second arms extending at angles from the center portion, a first tip on the first arm, the first tip extending parallel to the center portion, a second tip on the second arm, the second tip extending parallel to the center portion, and collinear with the first tip, means for rotatably securing the first and second tips to the key seat, means for supporting the center portion on the key seat and grasping means, on the key cap, for snapping onto the center portion, supported by the means for supporting, when the key cap is urged forcibly toward the key seat.

According to another embodiment of the present invention, there is disclosed, a keyboard switch assembly comprising: a key seat, a key cap, means for permitting motion of the key cap over a limited travel with respect to the key seat, a swing rod, the swing rod including a center portion and first and second tips, the first and second tips being parallel to the center portion, and collinear with each other, anchoring means in the key seat for rotatably retaining one of the center portion and the first and second tips, supporting means in the key seat for supporting the other of the center portion and the first and second tips, means on the key cap, aligned with the other, for engaging and rotatably gripping a portion of the other being supported by the supporting means, when the key cap is displaced forcibly toward the key seat for assembly of the key cap to the key seat.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
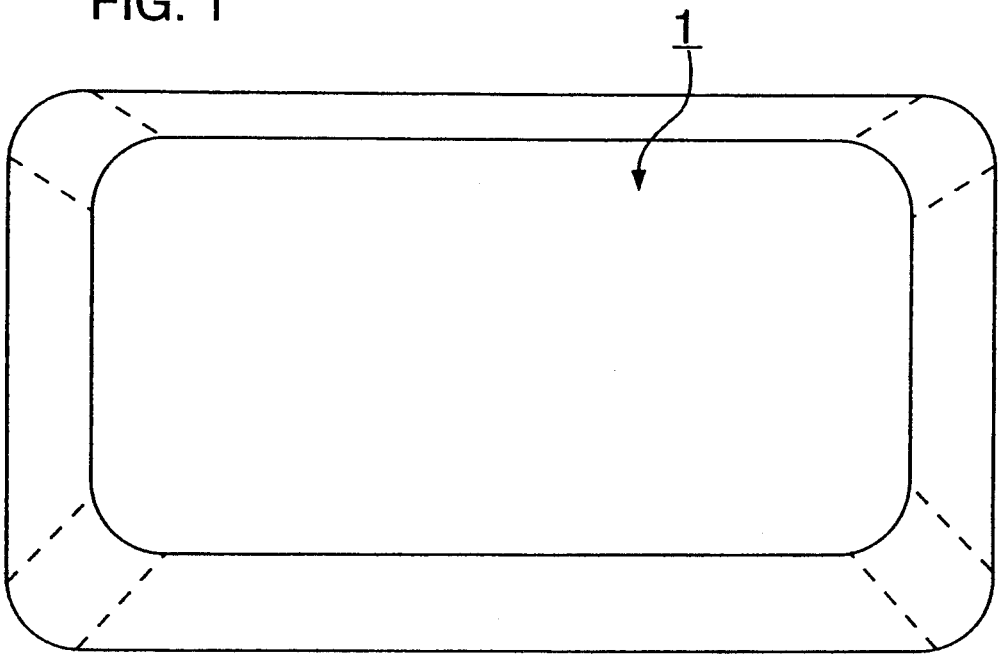
FIG. 1 is a top view of a key cap according to an embodiment of the present invention.
Figure 2:
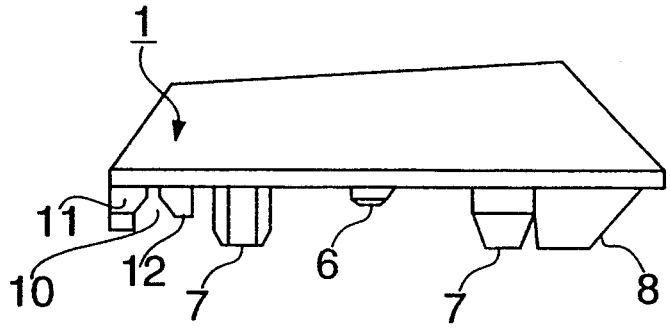
FIG. 2 is a side view of the key cap of FIG. 1.
Figure 3:
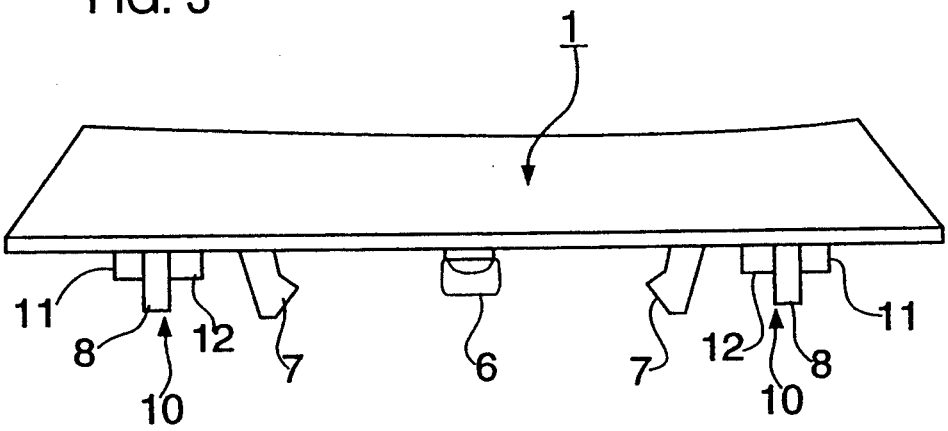
FIG. 3 is a front view of the key cap of FIG. 1.
Figure 4:
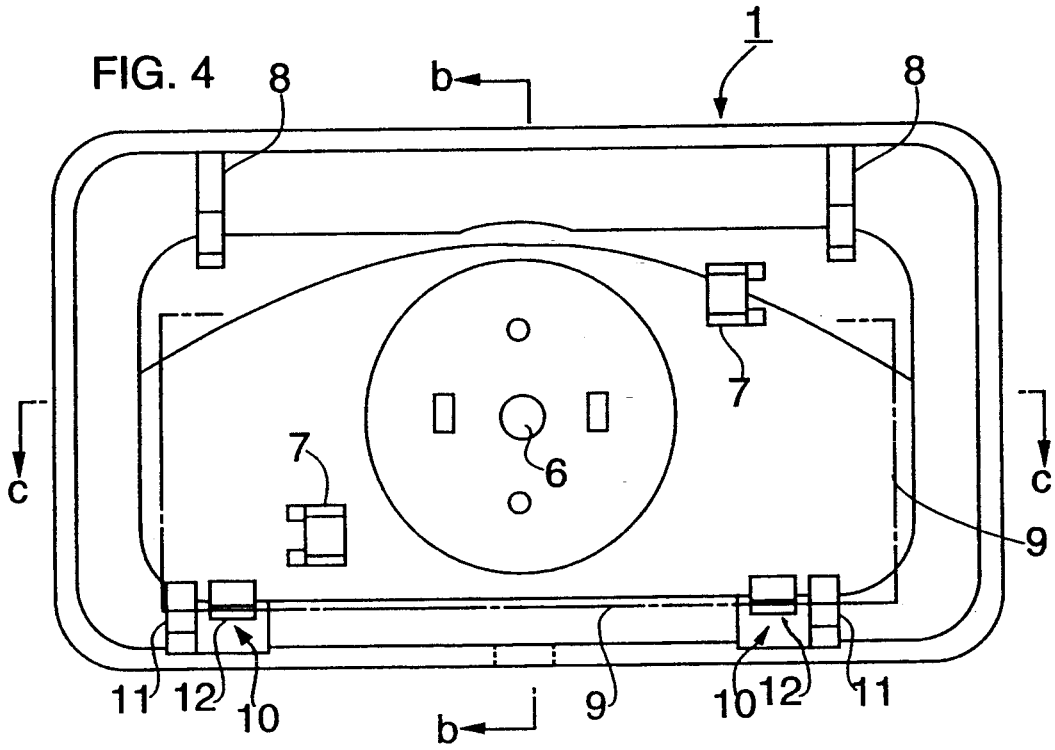
FIG. 4 is an underside view of the key cap of FIG. 1.

Referring to FIGS. 1 through 5, a rectangular key cap 1, of synthetic resin or other suitable material, includes a trigger projection 6 extending from a middle of its bottom surface. Trigger projection 6 presses switch contacts (not shown) to close a keyboard switch (not shown). A pair of hooked arms 7 lie at ends of a diagonal line on the bottom surface of key cap 1. Hooked arms 7 halt key cap 1 at a top of its stroke, keeping it from detaching from a key seat 4. A pair of guide members 8 on the bottom surface of key cap 1, along a rear edge of key cap 1, guide key cap 1 during a stroke.

Figure 8:
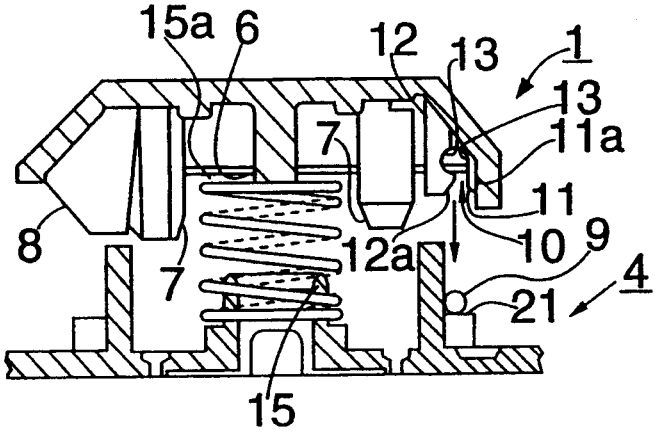
FIG. 8 is a section view taken along the line b—b of FIG. 5, with the arrows pointing from the observer to the subject.
Figure 9:
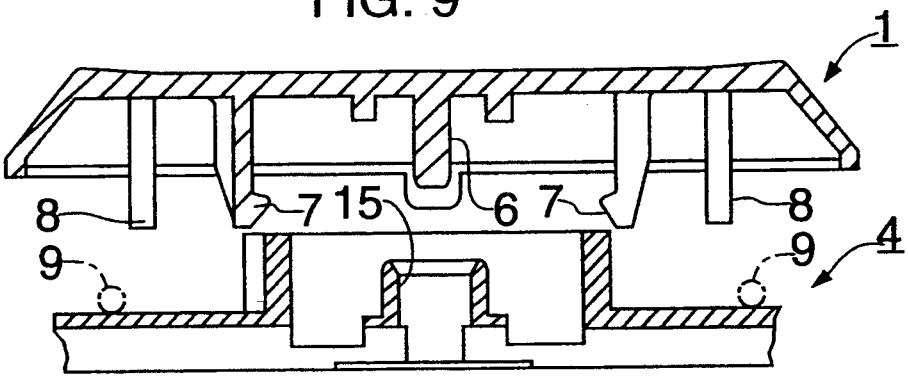
FIG. 9 is a section view taken along the line c—c of FIG. 5, with the arrows pointing from the observer to the subject.
Figure 10:
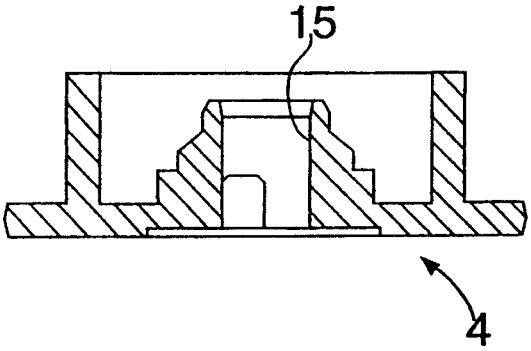
FIG. 10 is a section view taken along the line d—d of FIG. 5, with the arrows pointing from the observer to the subject.
Figure 11:
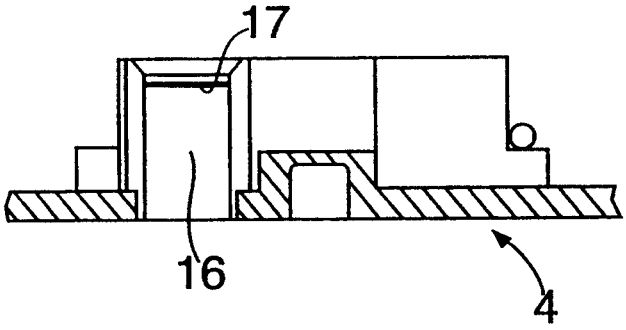
FIG. 11 is a section view taken along the line e—e of FIG. 5, with the arrows pointing from the observer to the subject.
Figure 12:
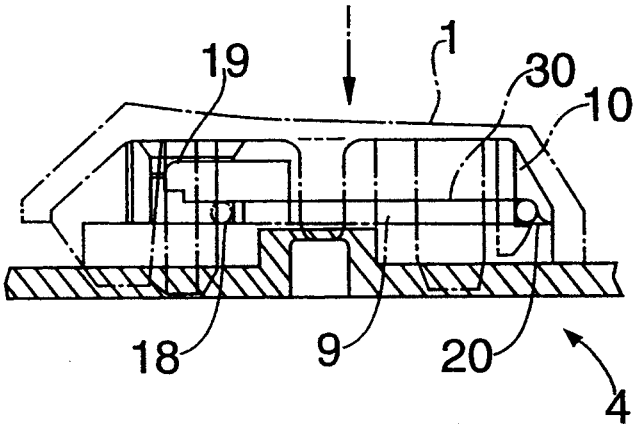
FIG. 12 is a section view taken along the line f—f of FIG. 5, with the arrows pointing from the observer to the subject.

Referring now also to FIG. 8, a pair of grips 10 project from the bottom surface of key cap 1, along a forward edge of key cap 1. Grips 10 pivotably grip swing rod 9. Each grip 10 consists of an exterior finger 11 and an interior finger 12. Interior finger 12 is longer than exterior finger 11. Facing surfaces of exterior and interior fingers i1 and 12 include respective semilunar recesses 13. A sloping portion 11*a* extends from a tip, to respective semilunar recess 13, of exterior finger 11. Another sloping portion 12*a* extends from a tip, to respective semilunar recess 13, of interior finger 12. Sloping portions 11*a* and 12*a* guide swing rod 9 into semilunar recesses 13 when swing rod 9 is snap-fitted into grips 10.

Swing rod 9 maintains a top surface of key cap 1 approximately normal to a direction of stroke. An urging means 15*a*, such as a rubber cup or a coil spring, is inserted between key cap 1 and key seat 4 to urge key cap 1 away from key seat 4.

Referring, now, to FIGS. 5 through 12, a hollow shaft 15, located in a center of key seat 4, receives trigger projection 6 of key cap 1. A pair of engagement slots 16, each having an engagement edge 17, lie at opposite ends of a diagonal line. Engagement edges 17 engage hooked arms 7 in key cap 1 to halt key cap 1 at the top of a stroke to keep key cap 1 from coming free.

Figure 5:
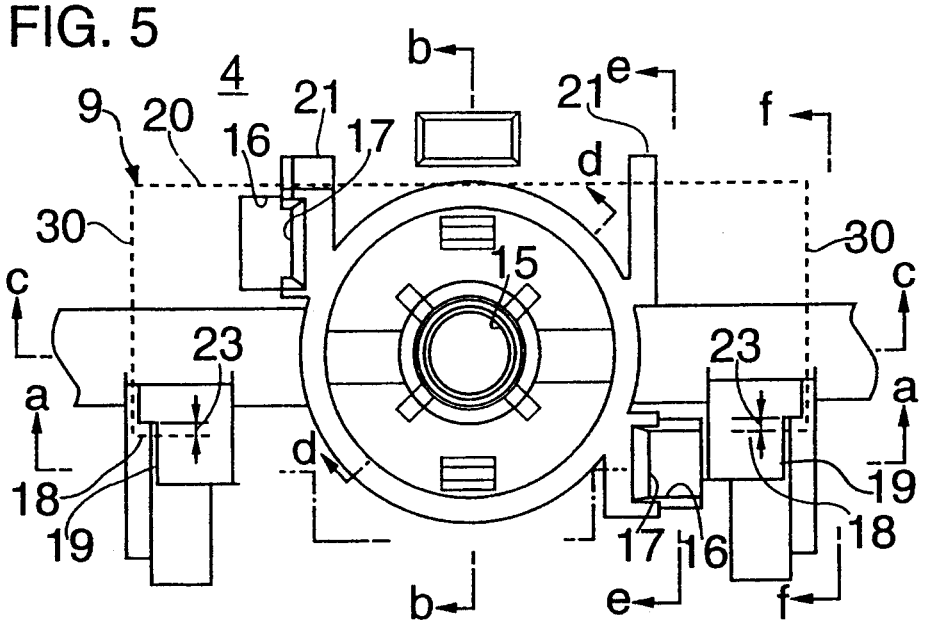
FIG. 5 is a top view of a key seat of a keyboard housing on which the key cap of FIG. 1 is mounted.
Figure 6:
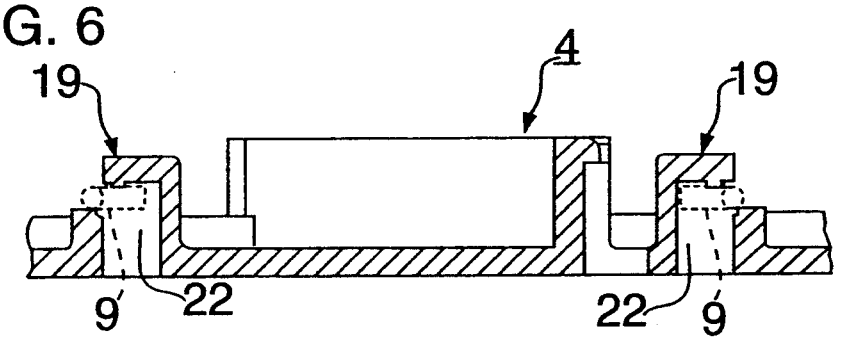
FIG. 6 is a section view taken along the line a—a of FIG. 5, with the arrows pointing from the observer to the subject.
Figure 7:
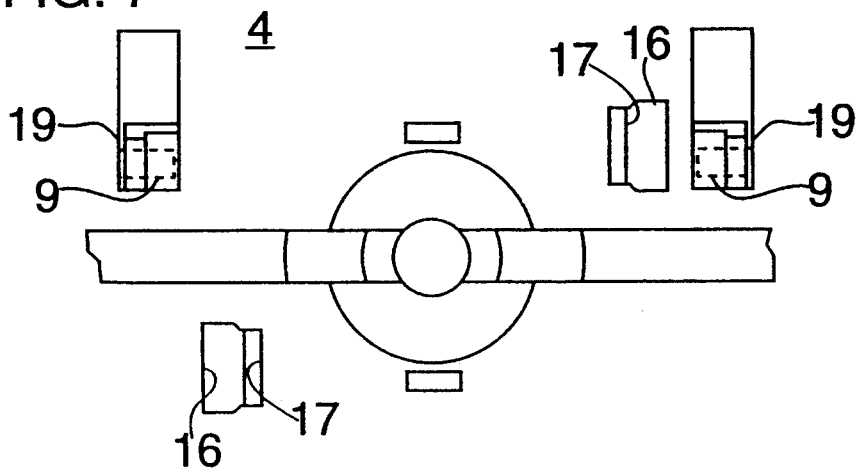
FIG. 7 is an underside view of the key seat of FIG. 5.

Swing rod 9, shown by a dashed line in FIG. 5., has a rectangular "C" shape with a center portion 20 and two arms 30 defining three sides of a rectangle. Two tips 18 extend toward each other partly along a fourth side of the rectangle, thereby forming right angles with respective arms 30.

Referring to FIG. 5, anchoring blocks 19, located along a rear edge of key seat 4 movably anchor tips 18 of swing rod 9. A left one of anchoring blocks 19 opens in a left direction and a rear direction. A right one of anchoring blocks 19 opens in a right direction and the rear direction. The rear and side-directed openings of each of anchoring blocks 19 are continuous, forming two legs of an L-shape. Opposite the rear-opening portion of the opening of each anchoring block 19 is an end wall 22. Tips 18 of swing rod 9 are anchored in anchoring blocks 19 by placing tips 18 at the rear portions of the openings of anchoring blocks 19 and then pulling swing rod 9 toward end walls 22 so that tips 18 fit into the openings of anchoring blocks 19. During assembly of a keyboard, swing rod 9 is placed on key seat 4 so that it embraces hollow shaft 15 at its diagonal center. Swing rod 9 is oriented so that center portion 20 lies along a forward edge of key seat 4. Tips 18 of arms 30 lie along the rear edge of key seat 4.

Key seat 4 has ridges 21 along the forward edge of key seat 4 to support center portion 20 of swing rod 9 prior to assembly of key cap 1 to key seat 4. During assembly, key cap 1 is aligned so that its rear and forward edges coincide with the rear and forward edges of key seat 4. Then key cap 1 is forced downward against key seat 4 and swing rod 9. Ridges 21 prevent center portion 20 from being pushed away by key cap 1 so that center portion 20 is snap-fitted into grips 10.

Gaps 23 between tips 18 of swing rod 9 and end walls 22 of anchoring blocks 19 are minimal. The minimal size of gaps 23 minimizes rotational play in a vertical axis of swing rod 9 and key cap 1. Thus, swing rod 9 helps prevent key cap 1 from rotating about the vertical axis when the key is pressed. Tips 18 of swing rod 9 are securely constrained in a vertical direction. This helps to eliminate rotational play of key cap 1 in a horizontal axis perpendicular to the axis of center portion 20.

When key cap 1 is pressed, it is forced against the urging means. Movement caused by pressing key cap 1 forces trigger projection 6 against switch contacts (not shown). If force is applied to only one end of key cap 1, the force is distributed to two ends of key cap 1 by swing rod 9. Accordingly, the top surface of key cap 1 is maintained in a plane approximately normal to the direction of stroke. When the force is removed, key cap 1 is returned to the top of its stroke by the urging means. The return movement is halted by hooked arms 7. Hooked arms 7 catch engagement edges 17 of engagement slots 16, preventing key cap 1 from detaching from key seat 4. Key cap 1 is prevented from rotating in a vertical plane by smallness of gaps 23.

Many key caps 1 and key seats 4 of a key board are assembled as follows. First, swing rods 9 are placed in position on key seats 4 by placing respective tips 18 of swing rod 9 at respective openings of anchoring blocks 19. Swing rods 9 are then pulled to slide respective tips 18 toward respective end walls 22. Tips 18 are thus snap-fitted into the openings of anchoring blocks 19. Swing rods 9 are put in position for all keys requiring swing rods. Key caps 1 are aligned and held over swing rods 9 and key seats 4 as described above. Then all key caps 1 are simultaneously pressed in the direction of stroke. All center portions 20 are thus simultaneously snap-fitted into grips 10 of all key caps 1 as key caps 1 are pushed toward their respective key seats 4.

Referring, now to FIG. 8, exterior fingers 11 and interior finger 12 constitute grips 10. Interior fingers 12 are longer than exteriors fingers 11. When swing rod 9 is press-fitted into grips 10, center portion 20 is guided by slopes 12*a* toward semilunar recesses 13 of interior fingers 12, and urged in the rear direction. Since tips 18 of swing rod 9 are anchored to anchoring blocks 19, swing rod 9 does not rotate when key cap 1 is pressed against it. Thus, although, swing rod 9 experiences a torque, anchoring blocks 19 prevent rod 9 from rotating clockwise. Ridges 21 firmly support center portion 20 of swing rod 9. Thus ridges 21 press-fit swing rod 9 into grips 10 of key cap 1.

Figure 13A:
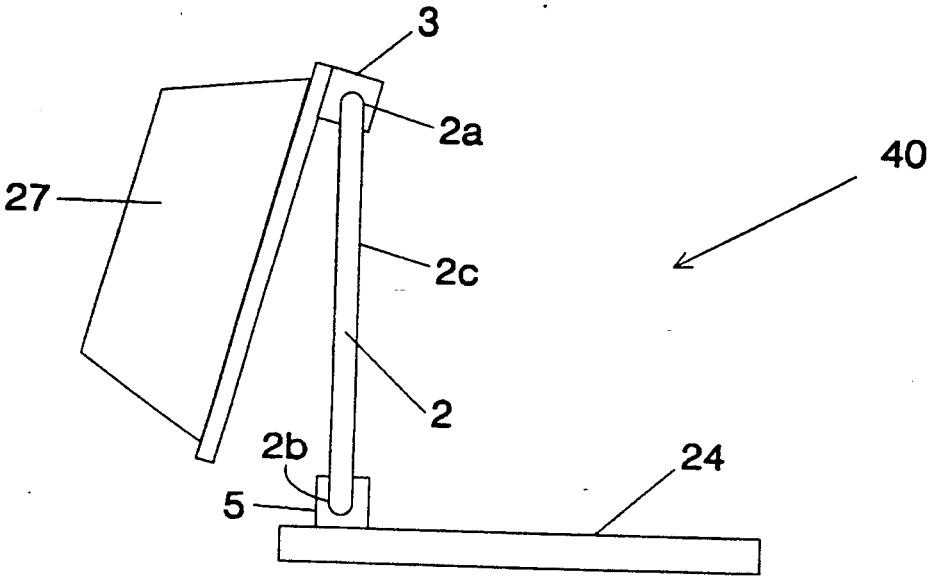
Fig. 13a Prior Art
FIG. 13*a* is a side view of a key cap, key seat and swing rod in a first stage of assembly.
Figure 13B:
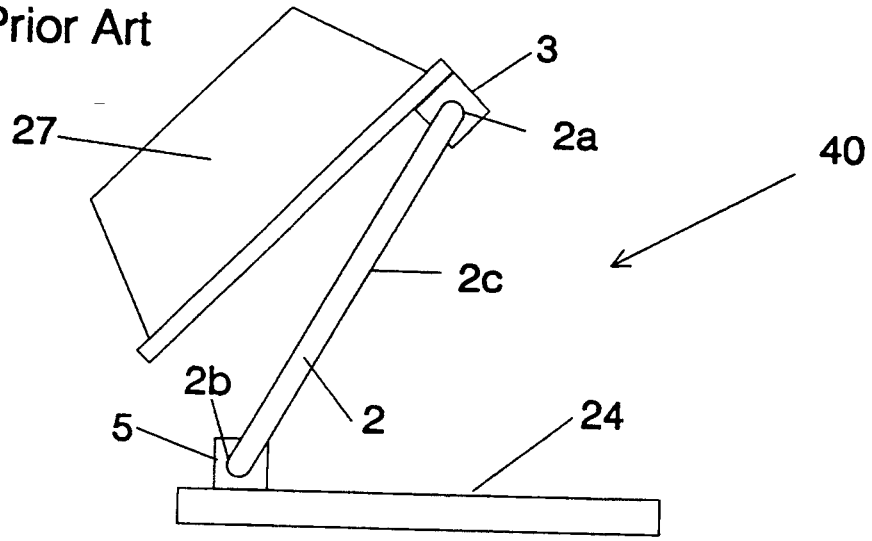
Fig. 13b Prior Art
FIG. 13*b* is a side view of a key cap, key seat and swing rod being moved to their home operating positions.
Figure 13C:
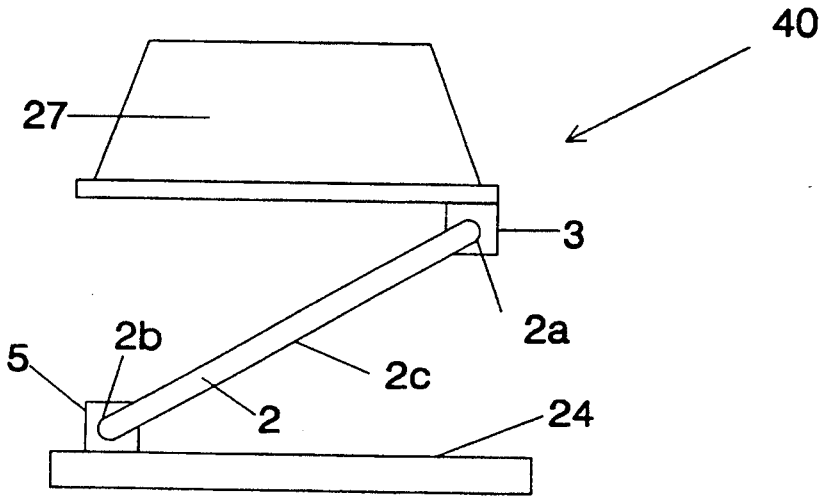
Fig. 13c Prior Art
FIG. 13*c* is a side view of a key cap, key seat and swing rod in their home operating positions.
Figure 13D:
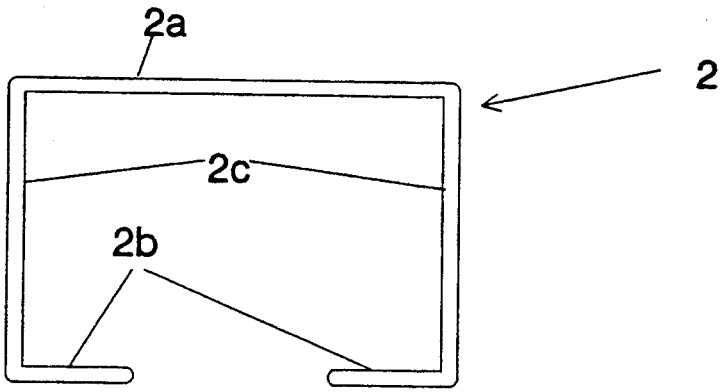
Fig. 13d Prior Art
FIG. 13*d* is a top view of a swing rod.

Referring to FIGS. 13*a* through 13*c*, in contrast, in assembling key a cap 27 according to the prior art structure, key cap 27, pressed in the direction of stroke, does not engage a center portion 2*a*. Since grips 3 open in a direction perpendicular to the direction of stroke, it is not in a position to receive swing rod 2. In addition, a torque is imposed on a swing rod 2 when key cap 1 is pressed. Since bearings 5 open upwardly, this torque causes rod tips 2*b* to disengage from bearings 5. Thus, the prior art structure cannot be used to assemble key caps 27, swing rods 2, and key seats 24 in a single step as can be done with the present invention.

According to the present embodiment, key cap 1 can easily be mounted on key seat 4 by pressing key cap 1 in the direction of stroke. Therefore, all key caps 1 for an entire keyboard unit can be mounted on respective key seats 4 in one operation by pressing all key caps 1 toward respective key seats 4 at one time.

According to the foregoing embodiment of this invention, interior fingers 12 are longer than exterior fingers 11, and anchoring blocks 19 open in the rear direction. It would be clear to one skilled in the art that an alternative embodiment of this invention, in which exterior fingers 11 are longer than interior fingers 12, and anchoring blocks 19 open in the forward direction, would fall within the spirit and scope of the invention. This configuration offers the same assembly advantages as those described above, in that swing rod 9 is held in position during press-fitting of key cap 1 to key seat 4.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A keyboard switch assembly, comprising:

a key cap;

a key seat, separate from said key cap;

means for limiting a movement of said key cap to a specified distance from said key seat;

means for urging said key cap away from said key seat until movement is stopped by said means for limiting;

a swing rod;

a center portion on said swing rod;

a first arm affixed to a first end of said center portion;

a second arm affixed to a second end of said center portion;

said first and second arms extending at angles from said center portion;

a first tip on said first arm;

said first tip extending parallel to said center portion;

a second tip on said second arm;

said second tip extending parallel to said center portion, and collinear with said first tip;

means for rotatably securing said first and second tips to said key seat;

means for supporting said center portion on said key seat; and grasping means, on said key cap, for snapping onto said center portion, supported by said means for supporting, when said key cap is urged forcibly toward said key seat.

2. A keyboard switch assembly as recited in claim 1 wherein said means for supporting is offset from said grasping means.

3. A keyboard switch assembly as recited in claim 1, wherein said key cap has a protrusion facing said key seat for operating an electrical switch.

4. A keyboard switch assembly as recited in claim 1, wherein:

said means for rotatably securing includes at least one member on said key seat;

said at least one member forming a recess;

said key seat has a forward end and a rear end;

said recess has an access facing one of said forward end and said rear end; and said recess has a blind end.

5. A keyboard switch assembly as recited in claim 1, wherein:

said grasping means has at least one recess; and said at least one recess opens toward said key seat.

6. A keyboard switch assembly as recited in claim 1, wherein said means for limiting movement includes:

a finger attached to one of said key seat and said key cap;

said finger having a notch; and the other of said key seat and said key cap including an edge engageable by said finger.

7. A keyboard switch assembly, comprising:

a key cap;

a key seat, separate from said key cap;

means for limiting a movement of said key cap to a specified distance from said key seat;

means for urging said key cap away from said key seat until movement is stopped by said means for limiting;

a swing rod;

a center portion on said swing rod;

a first arm affixed to a first end of said center portion;

a second arm affixed to a second end of said center portion;

said first and second arms extending at angles from said center portion;

a first tip on said first arm;

said first tip extending parallel to said center portion;

a second tip on said second arm;

said second tip extending parallel to said center portion, and collinear with said first tip;

means for rotatably securing said center portion to said key seat;

means for supporting said first and second tips on said key seat; and grasping means, on said key cap, for snapping onto said first and second tips, supported by said means for supporting, when said key cap is urged forcibly toward said key seat.

8. A keyboard switch assembly as recited in claim 7 wherein said means for supporting is offset from said grasping means.

9. A keyboard switch assembly as recited in claim 7, wherein said key cap has a protrusion facing said key seat for operating an electrical switch.

10. A keyboard switch assembly as recited in claim 7, wherein:

said means for rotatably securing includes at least one member on said key seat;

said at least one member forming a recess;

said key seat has a forward end and a rear end;

said recess has an access facing one of said forward end and said rear end; and said recess has a blind end.

11. A keyboard switch assembly as recited in claim 7, wherein:

said grasping means has at least one recess; and said at least one recess opens toward said key seat.

12. A keyboard switch assembly as recited in claim 7, wherein said means for limiting movement includes:

a finger attached to one of said key seat and said key cap;

said finger having a notch; and the other of said key seat and said key cap including an edge engageable by said finger.

* * * * *